US005802854A

United States Patent [19]

Maeda et al.

[11] Patent Number: 5,802,854

[45] Date of Patent: Sep. 8, 1998

[54] GAS TURBINE MULTI-STAGE COMBUSTION SYSTEM

[75] Inventors: Fukuo Maeda, Machida; Yasunori Iwai, Kawasaki; Yuzo Sato, Yokohama, all of Japan

[73] Assignee: Kabushiki Kaisha Toshiba, Kawasaki, Japan

[21] Appl. No.: 854,749

[22] Filed: May 12, 1997

Related U.S. Application Data

[63] Continuation of Ser. No. 394,275, Feb. 24, 1995, abandoned.

[30] Foreign Application Priority Data

Feb. 24, 1994 [JP] Japan ..... 6-026953

[51] Int. Cl.[6] ..... F23R 3/30; F23R 3/34

[52] U.S. Cl. ..... 60/737; 60/39.821; 60/746

[58] Field of Search ..... 60/39.06, 39.821, 60/39.822, 39.826, 39.827, 733, 737, 746, 747

[56] References Cited

U.S. PATENT DOCUMENTS 5,069,029 12/1991 Kuroda et al. ..... 60/737
5,127,229 7/1992 Ishibashi et al. ..... 60/747
5,311,742 5/1994 Izumi et al. .
5,319,935 6/1994 Toon et al. ..... 60/746

FOREIGN PATENT DOCUMENTS 2 280 022 1/1995 United Kingdom .

*Primary Examiner*—Louis J. Casaregola
*Attorney, Agent, or Firm*—Oblon, Spivak, McClelland, Maier & Neustadt, P.C.

[57] ABSTRACT

A gas turbine combustion system includes a cylindrical combustor, a plurality of combustion sections in an arrangement spaced apart in an axial direction of the combustor, a plurality of fuel supply lines independently connected to the combustion sections, respectively, premixed fuel supply sections respectively provided for the fuel supply lines for supplying a premixed fuel, a diffusion combustion fuel supply section for supplying a diffusion combustion fuel to the combustion sections, and a control switching over the fuel supply sections to selectively supply either one of the premixed fuel and the diffusion combustion fuel. The premixed fuel at a first combustion stage is burned while the premixed fuel of subsequent stage is ignited by a high-temperature gas generated from combustion of the premixed fuel of a preceding combustion stage.

18 Claims, 15 Drawing Sheets

$(t_1 < t_2 < t_3 < t_4 < t_5)$

GAS TURBINE MULTI-STAGE COMBUSTION SYSTEM

This application is a Continuation of application Ser. No. 08/394,275 filed on Feb. 24, 1995, now abandoned.

BACKGROUND OF THE INVENTION

The present invention relates to a gas turbine combustion system for use in, for example, a gas turbine plant or a combined plant. More particularly, the present invention pertains to a gas turbine combustion system designed to reduce the concentration of NOx contained in a gas turbine exhaust, and also pertains to a combustion control method therefor.

DISCUSSION OF THE BACKGROUND

The gas turbine employed in, for example, a gas turbine plant or a combined plant is operated to achieve high operational efficiency under high-temperature and high-pressure conditions, and this tends to increase NOx in an exhaust. Although various factors for generation of NOx are known, the dominant one is flame temperature. Therefore, how much the flame temperature can be reduced is the essential problem of the NOx reduction method.

The simplest and most common NOx reducing method in the conventionally adopted methods involves injection of steam or water into the high-temperature combustion area in a combustor for reducing the flame temperature during the combustion. Although this method is easy to carry out, it suffers from problems in that a large amount of steam or water is required, in that the use of steam or water results in a reduction in the plant efficiency and is against the realization of a plant with an operational high efficiency, and in that injection of a large amount of steam or water into the combustor increases combustion vibrations, thus reducing the lifetime of the combustor.

Taking the above defects into consideration, the dry type premixing multi-stage lean combustion method has been developed in recent years, in which fuel and combustion air are premixed with each other and burned under lean fuel condition. This method assures the same level of reduction effect of NOx as the level achieved by the steam or water injection method.

In order to cover the narrow combustion range which is a deficiency of the premixed combustion, the above-described premixing multi-stage lean combustion method adopts a flame structure which uses a diffusion combustion flame ensuring stable combustion over a wide fuel-air ratio range in addition to a premixed combustion flame. Furthermore, the fuel-air ratio control method has also been adopted, in which the average gas temperature after combustion is increased by changing an air ratio in the combustor during operation to stabilize the flames.

Although the dry type combustor employing the premixing multi-stage lean combustion method or fuel-air ratio control method offers advantages, it provides the following problems to be overcome.

FIG. 12 illustrates the relationship between the gas turbine load and the amount of NOx generated. As shown in FIG. 12, NOx discharge characteristics (b) of a dry type low-NOx combustor are very low in the gas turbine load range from (d) to (e) but are not very low in the low load range from (c) to (d), as compared with NOx characteristics (a) of a steam or water injection type combustor. Therefore, in a conventional dry type combustor, multiple fuel supply systems are adopted to alter part of the NOx characteristics (b) to low NOx characteristics indicated by a dot-dashed line, thereby achieving reduction in NOx in the low load range.

However, the NOx characteristics, e.g. characteristics (b), are still high over the entire gas turbine load range from the load (c) to the rated load (e) as compared with an aimed NOx value which can be set from the theoretically lowest NOx characteristics (g) with a margin taken into consideration.

More specifically, a conventional dry type low NOx combustor maintains stable combustion by a premixed flame supported by a diffusion flame, and NOx characteristics (j) thereof are substantially in inverse proportion to the diffusion flame fuel flow rate, as shown in FIG. 13.

Accordingly, a reduction in the proportion of the diffusion fuel flow rate as much as possible is desired in order to achieve further reduction in NOx. However, in a conventional dry type low NOx combustor, the minimum proportion of the diffusion fuel flow rate is determined by a proportion (1) of the diffusion fuel flow rate which can clear a CO limiting value (k) at each gas turbine load, as shown in FIG. 14. If the minimum proportion of the diffusion fuel flow rate is reduced to a value (1) or less, CO (or THC or the like) is increased, thus reducing combustion efficiency or increasing combustion vibrations and hence making stable operation impossible. If the minimum proportion of the diffusion fuel flow rate is set to a smaller value (m) or less, an accidental fire may occur. It has therefore been impossible to reduce NOx to a minimum value by reducing the proportion of diffusion fuel flow rate to zero because the stable combustion must be obtained and an accidental fire must be prevented.

Moreover, NOx greatly depends on premixing equivalence ratio $\phi p$, as shown in FIG. 15. In order to reduce the NOx discharge level to an objective value (which may be 10 ppm) or less, the combustion region premixing equivalence ratio $\phi p$ will have to be set to a value less than n.

Furthermore, as shown in FIG. 16, the wall surface cooling air ratio (the ordinates of the graph shown in FIG. 16) has fixed relations with a combustor outlet equivalence ratio $\phi p$ or a combustor output temperature Tg and the combustion region premixing equivalence ratio $\phi p$ (the abscissas). More specifically, since $\phi p$ must be set to a value less than n (which corresponds to parameter $\phi p$ shown in FIG. 15) to set NOx to the aimed value or less, as shown in FIG. 15, the combustor outlet temperature is increased (or the combustor outlet equivalence ratio $\phi p$ EX is increased), and the wall surface cooling air ratio is reduced, as shown in FIGS. 16A and 16B. In other words, a reduction in NOx requires setting $\phi p$ to a small value which is close to the combustion limiting value, and reduces cooling air, thus making cooling difficult.

SUMMARY OF THE INVENTION

An object of the present invention is to substantially eliminate defects or drawbacks encountered in the prior art described above and to provide a gas turbine combustion system and a combustion control method therefor capable of exhibiting low NOx discharge characteristics of 10 ppm or less over the entire gas turbine load range, which would not be achieved by a conventional dry type low NOx combustor.

This and other objects can be achieved according to the present invention by providing, in one aspect, a gas turbine combustion system comprising:

- a cylindrical combustor having one end closed by a header;

a plurality of combustion sections in an arrangement spaced apart in an axial direction of the combustor;

a plurality of fuel supply lines independently connected to the combustion sections, respectively;

premixed fuel supply sections respectively provided for the fuel supply lines for supplying a premixed fuel;

a diffusion combustion fuel supply section for supplying a diffusion combustion fuel to the combustion sections; and a control unit for switching over the fuel supply sections to selectively supply either one of the premixed fuel and the diffusion combustion fuel.

In preferred embodiments, the combustion sections include a first combustion stage, a second combustion stage and succeeding combustion stages and the fuel supply lines include a fuel supply line for the first combustion stage which is divided into two fuel supply sections, one of which is connected to a diffusion combustion fuel nozzle of the diffusion fuel supply section and another one of which is connected to a premixed fuel nozzle of the premixed fuel supply section so that the control unit switches over the combustion condition from diffusion combustion to premixed combustion during operation of the gas turbine combustion system. The combustion sections include a first to fifth combustion stage including a combustion region in which the premixed fuel is burned and wherein an igniter for providing ignition energy is disposed in the combustion region.

The combustion sections are formed as first and second combustion chambers defined by first and second cylindrical members, respectively, the first cylindrical member having an inner diameter smaller than that of the second cylindrical members, and the first combustion chamber has the first to third combustion stages while the second combustion chamber has the fourth to fifth combustion stages. The first cylindrical member comprises an upstream side first cylindrical portion and a downstream side second cylindrical portion and an assembly including a pilot burner, a premixing device and an ignition device is mounted to an upstream side end of the first cylindrical portion, while another assembly including another premixing device and another ignition device is mounted to the second cylindrical portion. The premixing devices are formed as premixing ducts arranged along circumferential directions of the first and second cylindrical portions and are provided with fuel nozzles to upstream side air intake ports. The pilot burner comprises a diffusion fuel nozzle, a premixture fuel nozzle and a swirler which are disposed along a central axis of the first cylindrical member.

An assembly including a premixing device and an ignition device is mounted to the second combustion chamber, and the premixing device is formed as premixing ducts arranged along a circumferential direction of the second combustion chamber.

A flow sleeve for covering an outer peripheral side of an inner cylindrical member and a tail cylindrical member constituting the combustor is provided, the flow sleeve having a large number of holes through which a combustion air jet is caused to collide against an outer surface of the the inner cylindrical member and an outer surface of said tail cylindrical member to cool a metal constituting the inner cylindrical member and tail cylindrical member, and the total area of cooling air holes for film cooling, in which air is caused to flow into the combustor to cool a wall surface metal of the inner cylindrical member and the tail cylindrical member, is set to 20% or less of a total area for combustion air.

In another aspect of the present invention, there is provided a combustion control method for a gas turbine combustion system of the structure described above, wherein the premixed fuel at a first combustion stage is burned while the premixed fuel of a subsequent stage is ignited by a high-temperature gas generated from combustion of the premixed fuel of a preceding combustion stage.

The premixed fuels of the first, second, third, fourth and fifth stages of the plurality of combustion stages are separately supplied and burned in series in the order of the first stage fuel, the second stage fuel, the third stage fuel, the fourth stage fuel and then the fifth stage fuel as a gas turbine load is increased, while when the gas turbine load is reduced, the premixed fuels are reduced in a reversed manner to that followed when the load is increased in the order of the fifth stage fuel, the fourth stage fuel, the third stage fuel, the second stage fuel and the first stage fuel, and when the load is interrupted, supply of only the fourth stage fuel and the fifth stage fuel is suspended.

The premixed fuels of first, second, third, fourth and fifth stages of the plurality of combustion stages are defined by fuel flow rate functions, a dependent variable of which is a gas turbine load, and are supplied in response to a signal relating to the fuel flow rate functions relative to the load stored.

According to the present invention of the characters described above, the fuel of the first stage, which can be injected either from the diffusion combustion nozzle or the premixed combustion nozzle, is entirely supplied to the diffusion combustion nozzle at a first stage. The supplied fuel is ignited by the igniter or a pilot flame provided near the premixed fuel injection port of the first stage.

After the ignition, the supply of the fuel of the first stage is switched from the diffusion combustion nozzle to the premixed combustion nozzle, whereby a premixed combustion state is realized. Thereafter, the premixed fuels of the first, second, third, fourth and fifth stages are supplied from the fuel supply lines by an instruction from the computing element according to the fuel flow rate functions corresponding to a gas turbine load. The premixed fuel of the second stage is ignited and burned by a high-temperature gas generated by the combustion of the premixed fuel of the first stage. The premixed fuel of the third stage is ignited and burned by the entirety of a high-temperature gas generated from the combustion of the premixed fuels of the first and second stages. Similarly, the premixed fuels of the fourth and fifth stages are ignited and burned by the total amount of the high-temperature gas generated from the combustion of the premixed fuels of the upstream stages. Accordingly, the premixed fuels of the first, second, third, fourth and fifth stages are burned in series while sequentially expanding their flames downstream starting from the first stage.

Thus, the combustion of all the stages can be made to be a 100% premixed combustion. The premixed fuel, which is a uniform mixture of air and fuel, supplied to each of the stages, is set to the fuel lean condition, and thus burned at a flame temperature of 1600° C. which ensures generation of no NOx in the combustion region of each stage or below.

Consequently, the combustion is performed at a temperature of 1600° C. or below over the entire region of the combustor, and substantially no NOx is generated. As a result, NOx can be greatly reduced.

Further, since series combustion in which flames expand downstream is adopted, downstream unburned premixed gas is activated and readily burned by both an upstream high-temperature gas and chemically active groups contained in the high-temperature gas. Thus, conventionally unstable flames are stabilized. That is, adoption of five stages of series combustion in the present invention enables stabilization of flames and great reduction in NOx.

In order to accelerate stabilization of the flames, a pilot burner for giving ignition energy, a heating rod made of an electric heater or a stabilizing or ignition device employing electric or magnetic energy or plasma may be provided in the combustion region where the premixed fuel of the first, second, third, fourth or fifth stage is burned.

Air is adequately supplied to the premixed fuel of the first, second, third, fourth or fifth stage so that the premixed fuel can be set to the fuel lean condition ensuring a flame temperature of 1600° C. or below. In that case, since convection cooling of the inner tube and tail pipe is intensified by employing the flow sleeve having a large number of impinge cooling holes, the proportion of the film cooling air can be reduced to 20% of the air which enters the combustor or less. Since the amount of cooling air reduced can be utilized again as combustion air, adequate air required to set the fuel lean condition can be secured.

According to the wall surface cooling structure of the present invention, since the proportion of the cooling air is reduced and the amount of air reduced can be supplied as the premixing air, the fuel lean combustion condition can be realized. Consequently, a reduction in NOx can be achieved. Further, the series combustion allows for stabilization of unstable flames (since the fuel lean combustion condition offers a low combustion temperature, the flame readily becomes unstable). As a result, stable combustion characterized by the super low NOx can be achieved over the entire load range of a gas turbine.

The further nature and features of the present invention will be made clear from the following descriptions made with reference to the accompanying drawings.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

An embodiment of a gas turbine combustion system according to the present invention will be described below with reference to the accompanying drawings.

Figure 1:
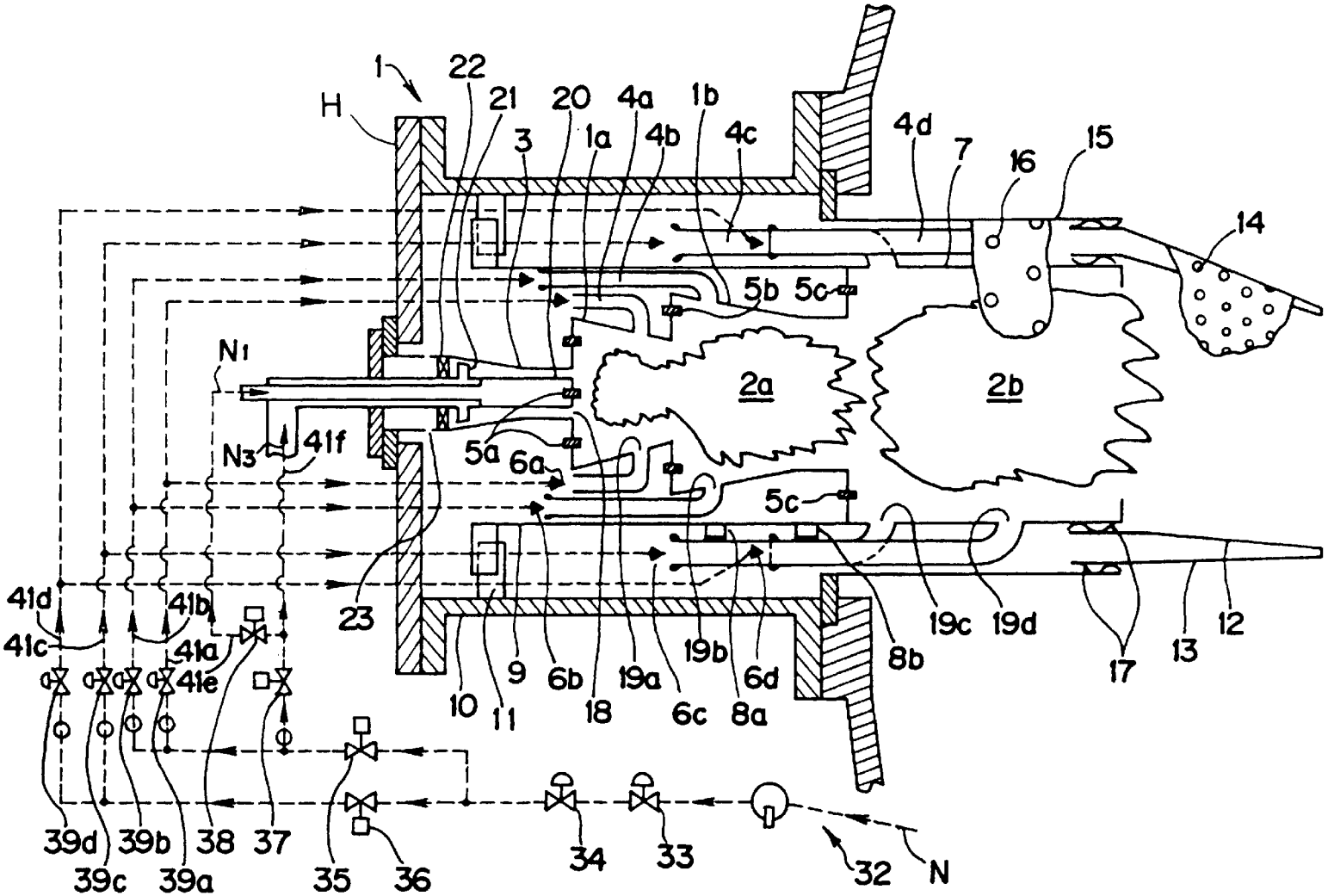
FIG. 1 illustrates an embodiment of a gas turbine combustion system according to the present invention

FIG. 1 illustrates the structure of the gas turbine combustion system according to the prevent embodiment. As shown in the figure, the combustion system is provided with a combustor 1 having a cylindrical, for example, structure closed at one end by a header H and including a first combustion chamber 2*a* having a three-stage combustion portion, and a second combustion chamber 2*b* having a two-stage combustion portion. The first combustion chamber 2*a* has a structure in which a pair of inner tubes 1*a* and 1*b* having small diameters are coupled to each other in the direction of a gas stream.

The small-diameter inner tube 1*a* located on an upstream side in the first combustion chamber 2*a* is provided with a pilot burner 3, premixing units 4*a* and at least one micro burner 5*a* (which may be a heater rod heated by an electric heater or other ignition device designed to discharge ignition energy by utilizing electric or magnetic energy). The pilot burner 3 is on the other end mounted to the header H. The small-diameter inner tube 1*b* located on a downstream side in the first combustion chamber 2*a* is provided with premixing units 4*b* and at least one micro burner 5*b*. The premixing units 4*a* or 4*b*, each having a configuration of a premixing duct, are arrayed in a number ranging from 4 to 8 in a peripheral direction of the inner tube 1*a* or 1*b*. Fuel nozzles 6*a* and 6*b* are disposed at air inlets of the premixing units 4*a* and 4*b*, respectively.

The second combustion chamber 2*b* includes an inner tube 7 having a diameter larger than those of the inner tubes 1*a* and 1*b*, premixing units 4*c* and 4*d* and at least one micro burner 5*c*. The premixing units 4*c* or 4*d*, each having a configuration of a premixing duct, are arrayed in a number ranging from 4 to 8 in a peripheral direction of the large-diameter inner tube 7.

Fuel nozzles 6*c* and 6*d* are disposed at upstream sides of the premixing units 4*c* and 4*d*, respectively. The premixing units 4*a*, 4*b*, 4*c* and 4*d* are fixed to a dummy inner tube 9 by means of supports 8*a* and 8*b* (only part of which is illustrated). The axial position of the dummy inner tube 9 is set by supports 11 fixed to a casing 10 so that the dummy inner tube 9 can receive thrusts acting on the small-diameter inner tubes 1*a* and 1*b* and the large-diameter inner tube 7.

An inner wall 12 of a tail pipe and an outer wall 13 of a tail pipe 13 are provided downstream of the large-diameter inner tube 7. The tail pipe outer wall 13 is formed with a large number of cooling holes 14. Similarly, a flow sleeve 15, having a large number of cooling holes 16, is provided on an outer peripheral side of the large-diameter inner tube 7. A tie-in portion between the large-diameter inner tube 7 and the tail pipe inner wall 12 and a tie-in portion between the flow sleeve 15 and the tail pipe outer wall 13 are sealed by means of spring seals 17, respectively.

Figure 2:
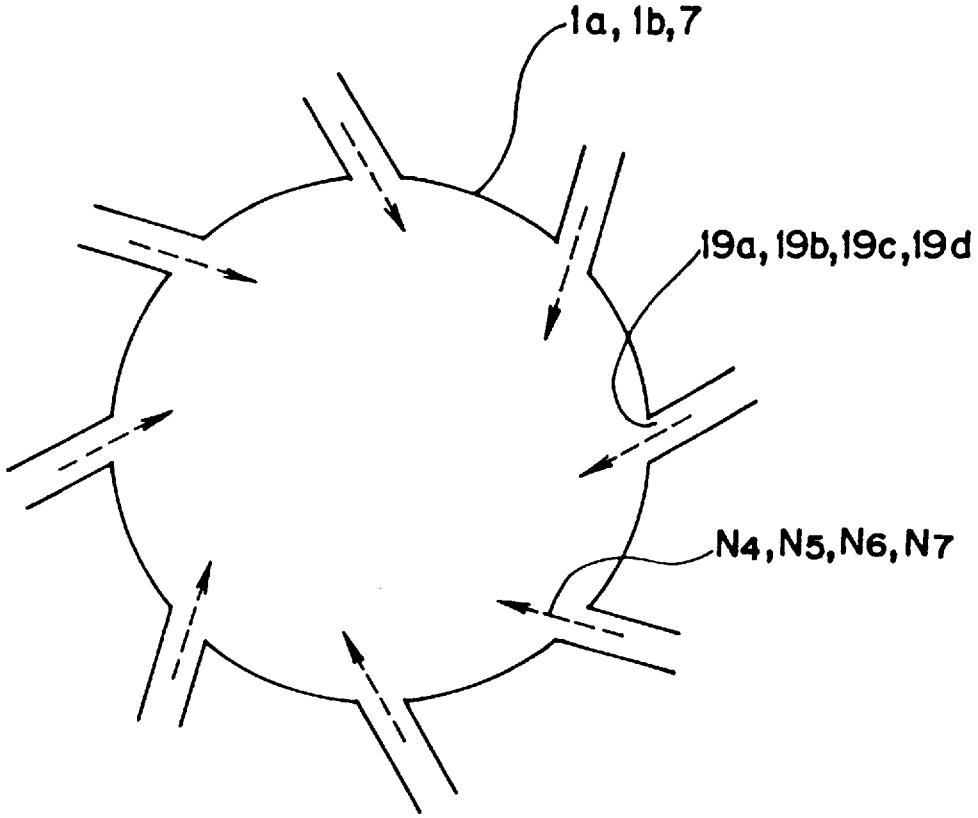
FIG. 2 is a cross-sectional view of part of the gas turbine combustion system of FIG. 1.

A premixed fuel injection port 18 of the first stage is provided at the upstream end of the small-diameter inner tube 1*a*. Outlets of the premixing units 4*a*, 4*b*, 4*c* and 4*d* provided in the inner tubes 1*a*, 1*b* and 7 serve as premixed fuel injection ports of the second, third, fourth and fifth stages 19*a*, 19*b*, 19*c* and 19*d*, respectively. The premixed fuel injection ports of the second, third, fourth and fifth stages 19*a*, 19*b*, 19*c* and 19*d* are disposed at predetermined intervals which ensure that the series combustion can be conducted adequately in the axial direction of the combustor. The premixed fuel may be injected from the injection ports 19*a*, 19*b*, 19*c* and 19*d* toward the center of the combustor. The injection ports may also be disposed in a spiral fashion so that the gas stream can have a swirling component, as shown in FIG. 2.

Figure 3:
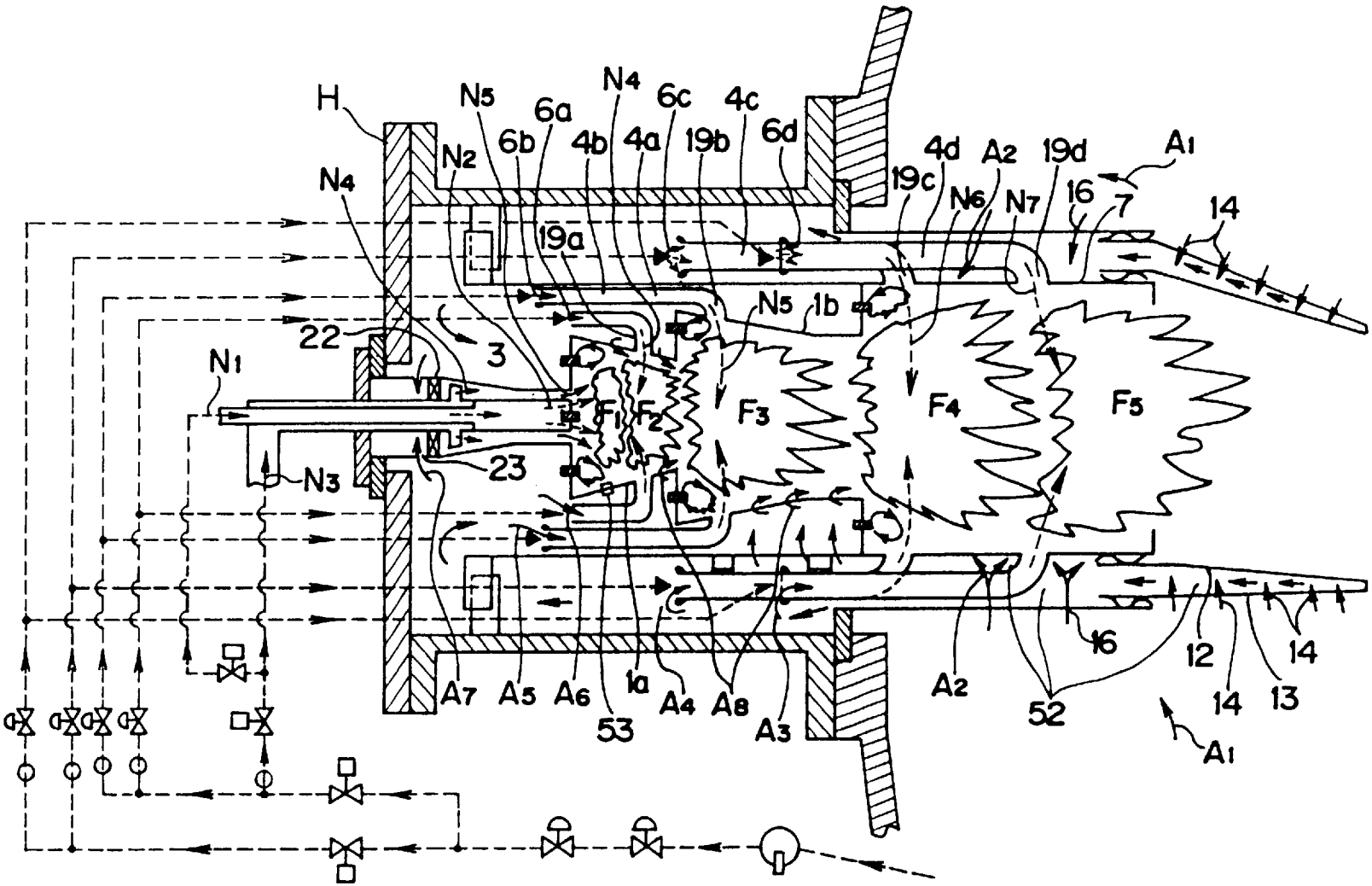
FIG. 3 is a view explaining the function of the embodiment shown in FIG. 1.

The pilot burner 3 includes a diffusion fuel nozzle 20 located along a central axis of the small-diameter inner tube 1*a*, a premixed fuel nozzle 21 and a swirler 22. A peripheral wall constituting the portion of the pilot burner 3 located upstream of the swirler 22 has a large number of air holes 23. The burning state of the pilot burner 3 is illustrated in FIG. 3. Operation of the pilot burner 3 is described herebelow.

Figure 4:
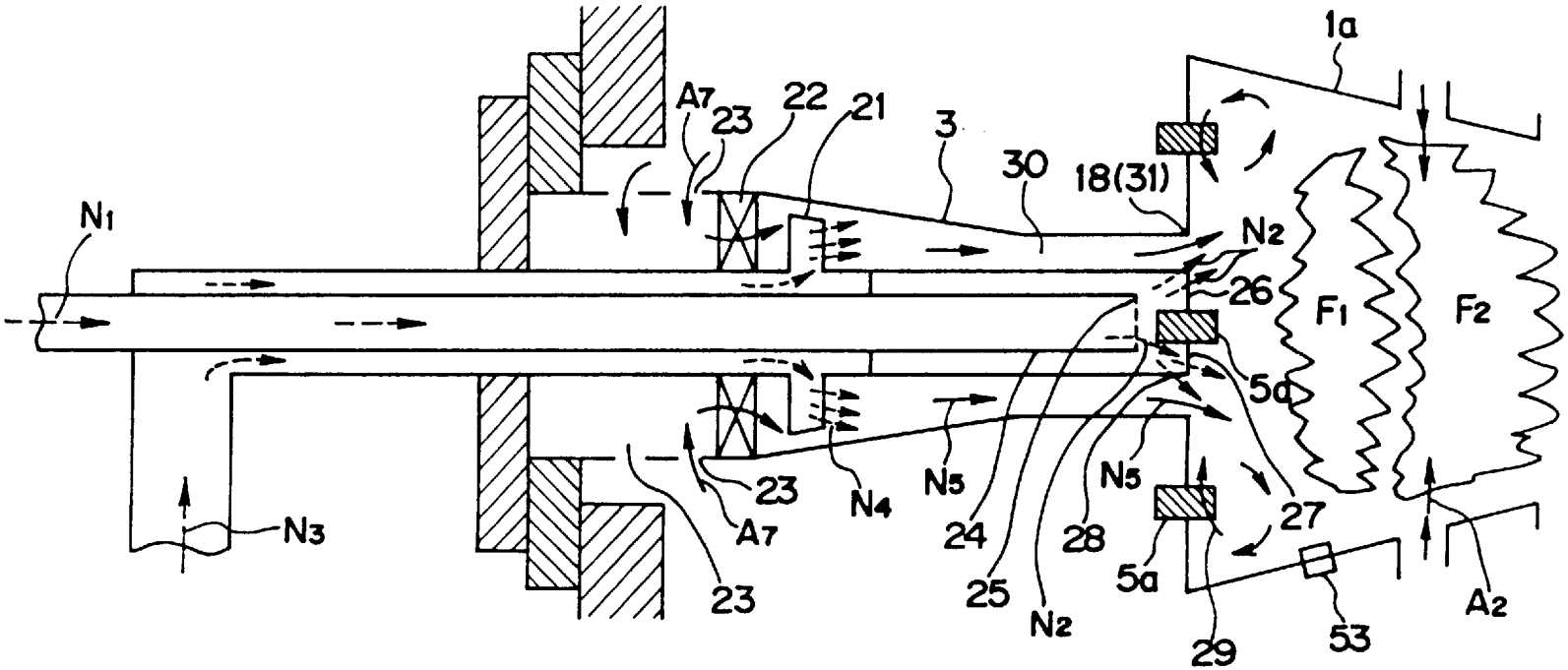
FIG. 4 is an enlarged view of the pilot burner in the embodiment shown in FIG. 1.

FIG. 4 illustrates the structure of the pilot burner 3 in greater detail. A distal end of a pilot diffusion fuel supply pipe 24 has injection holes 25. The injection holes 25 are located close to and in opposed relation with a nozzle distal end 26. The nozzle distal end 26 has injection holes 27 and 28 through which a diffusion fuel is injected.

The micro burners 5*a*, serving as ignition sources, are provided near the central portion of the nozzle distal end 26 and an inverted flow area 29. A flow passage 30 is formed on an outer peripheral side of the pipe 24. A distal end of the flow passage 30 has an injection port 31 through which a premixed fuel, which is a mixture of a combustion air and a fuel, is injected into the combustion chamber.

As shown in FIG. 1, a fuel supply system 32 has a fuel pressure adjusting valve 33 and a fuel flow rate adjusting valve 34 and is designed to supply a fuel to the fuel nozzles 6*a* to 6*d* through cutoff valves 35 and 36, a fuel flow rate adjusting valve 37, a distributing valve 38 and fuel flow rate adjusting valves, 39*a*, 39*b*, 39*c* and 39*d*.

Figure 5:
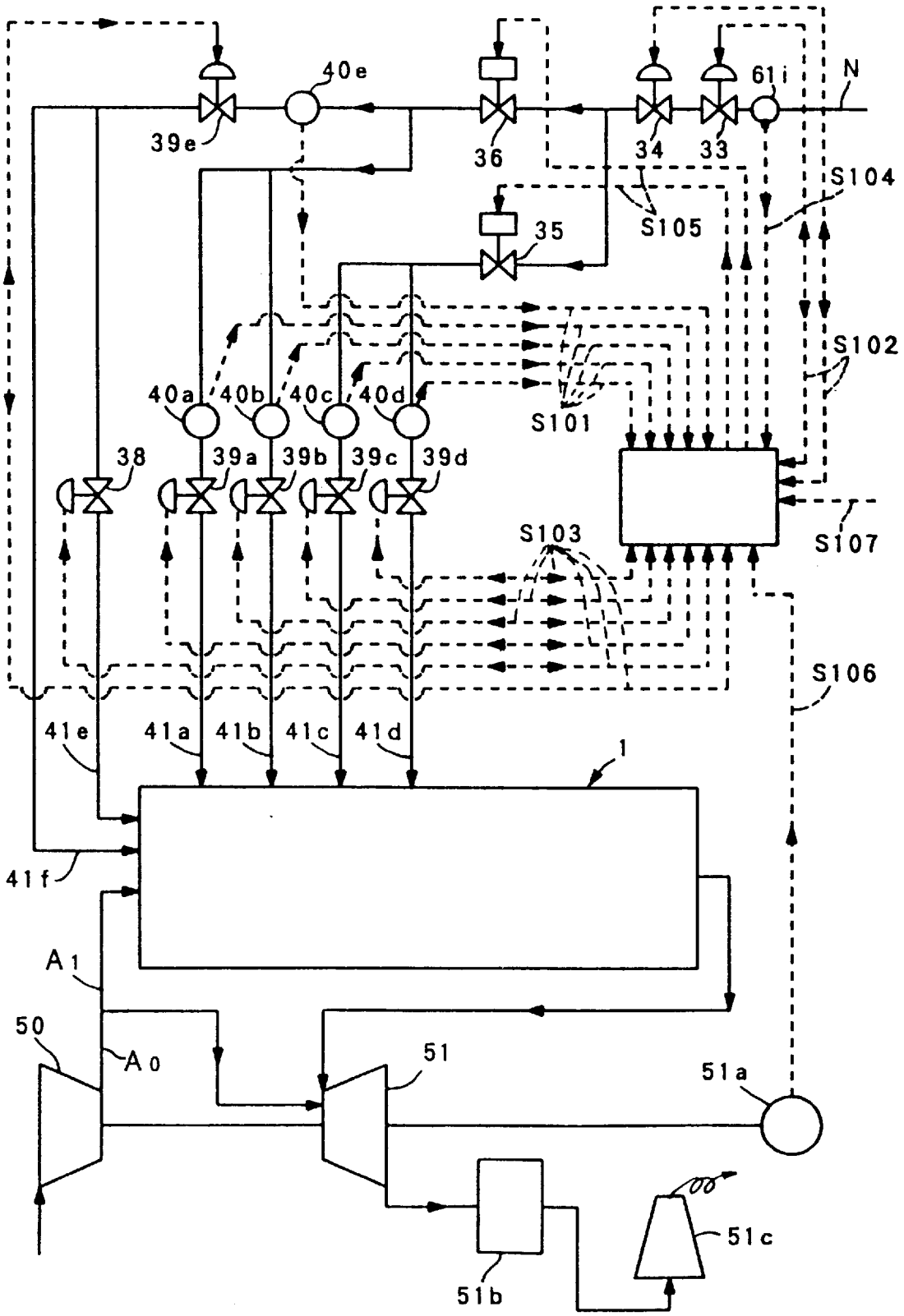
FIG. 5 illustrates a fuel system of the embodiment shown in FIG. 1.

FIG. 5 illustrates a configuration of the fuel supply system. A fuel N, which has passed through the pressure adjusting valve 33 and the flow rate adjusting valve 34, is distributed into two systems.

One of the two systems extends through the cutoff valve 36 and is then divided into two system lines. One of these two system lines is in turn divided into a line 41*a* which extends through a flow meter 40*a* and the flow rate adjusting valve 39*a* and a line 41*b* which extends through a flow meter 40*b* and the flow rate adjusting valve 39*b* while the other one of the system lines extends through a flow meter 40*e* and the flow rate adjusting valve 39*e* and is divided into a line 41*e* which extends through the flow rate adjusting valve 38 and another line 41*f*.

The system line which extends through the flow rate adjusting valve 34 extends through the cutoff valve 35 and is then divided into a line 41*c* which extends through a flow meter 40*c* and the flow rate adjusting valve 39*c*, and a line 41*d* which extends through a flow meter 40*d* and the flow rate adjusting valve 39*d*.

Signals S101, S102, S103, S104 and S105 output from all the above-described adjusting valves, the cutoff valves, the flow meters and so on, an output signal S106 of a generator 51*a* and a load signal S107 are supplied to a computing element 42. The computing element 42 controls the input signals according to the load signal 107 on the basis of a schedule input in the computing element 42. Reference numeral 51*b* denotes a denitration device and reference numeral 51*c* denotes a chimney.

Operation of the combustor 1 is described hereinbelow.

First, the flow of air will be explained with reference to FIGS. 3 and 5. As shown in FIG. 5, part of high-temperature/high-pressure air A0 ejected from an air compressor 50 is used to cool a turbine 51. Part of air A0 is supplied to the combustor 1 as a combustor air A1. The combustor air A1 passes through the tail pipe cooling holes 14 and 16 and flows into a gap 52 as an impinging jet A2 to cool the tail pipe inner wall 12 and the large-diameter inner tube 7 due to a convection flow.

The impinging jet A2 does not flow into the combustor 1 at the region of the tail pipe inner wall 12 and the large-diameter inner tube 7 so that it can flow into the premixing duct units 4*a*, 4*b*, 4*c* and 4*d* as combustion airs A3, A4, A5 and A6, respectively. The impinging air A2 also flows into the pilot burner 3 through the combustion air holes 23 as a combustion air A7. The impinging air A2 also flows downstream in the gap 52 so that it can be used as a film cooling air A8 of the small-diameter inner tubes 1*a* and 1*b*.

The flow of air and fuel in the pilot burner 3 will be described below.

The combustion air A7 which has flowed from the air holes 23 shown in FIG. 4 is swirled by the swirler 22 so that it has angular momentum. The resulting swhirling air flows into the small-diameter inner tube 1*a* through the injection port 31. The injection port 31 shown in FIG. 4 corresponds to the premixed fuel injection port 18 of the first stage shown in FIG. 2. A pilot diffusion fuel N1 ejects, as a jet, through the holes 25 formed at the downstream side of the pipe 24 to cool the nozzle distal end 26 by the convection flow, and then flows into the small-diameter inner tube 1*a* through the injection port 27 as a diffusion fuel N2. The diffusion fuel N2 is ignited by, for example, an igniter 53 provided on the peripheral wall of the small-diameter inner tube 1*a* to form a pilot flame F1. After ignition, the diffusion fuel N1 is gradually replaced with a premixed fuel N3 in response to the signal S103 from the computing element 42.

The premixed fuel N3 is showered through the premixed fuel nozzle 21 as a fuel N4. The fuel N4 is uniformly premixed with the combustion air A7. A resultant premixed fuel N5 increases its speed to a velocity twice the turbulent combustion speed or more as it swirls downstream and then flows into the small-diameter inner tube 1*a* from the premixed fuel injection port 18 of the first stage, i.e. the injection port 31. At that time, no backfire occurs from the pilot flame F1 because the velocity of the fuel is twice the turbulent combustion speed or more. By the time the fuel replacement is completed, all the pilot flame F1 becomes a premixed mixture flame obtained from the premixed mixture fuel N3, and hence generation of NOx is almost reduced to zero.

Next, the flow of fuel in the combustor inner tube and the combustion method will be described hereunder.

First, the pilot flame F1 is formed in the small-diameter inner tube 1*a* by the above-described method. The flame F1 is stabilized because of a desired combination of the pilot diffusion fuel N1 with the pilot premixed fuel N3. After the pilot flame F1 has been formed, the fuel having a flow rate controlled on the basis of the output signal S103 of the computing element 42 is uniformly mixed with air in the premixing unit 4*a*. A resultant premixed fuel N4 flows into the small-diameter inner tube 1*a* through the premixed fuel injection ports 19*a* of the second stage.

The premixed fuel N4 is ignited and burned by the pilot flame F1 located upstream of the premixed fuel N4 to form a premixed flame F2. Next, a premixed fuel N5 of the third stage similarly flows into the small-diameter inner tube 1*b* from the premixed fuel injection ports 19*b* of the third stage. The premixed fuel N5 is ignited and burned by the total amount of combustion gas obtained by adding the pilot flame F1 to the premixed flame F2 located upstream of the premixed fuel N5 thereby to form a premixed flame F3. Premixed fuels N6 and N7 of the fourth and fifth stages respectively form premixed flames F4 and F5 by the same process as that of the second and third stages.

Figure 12:
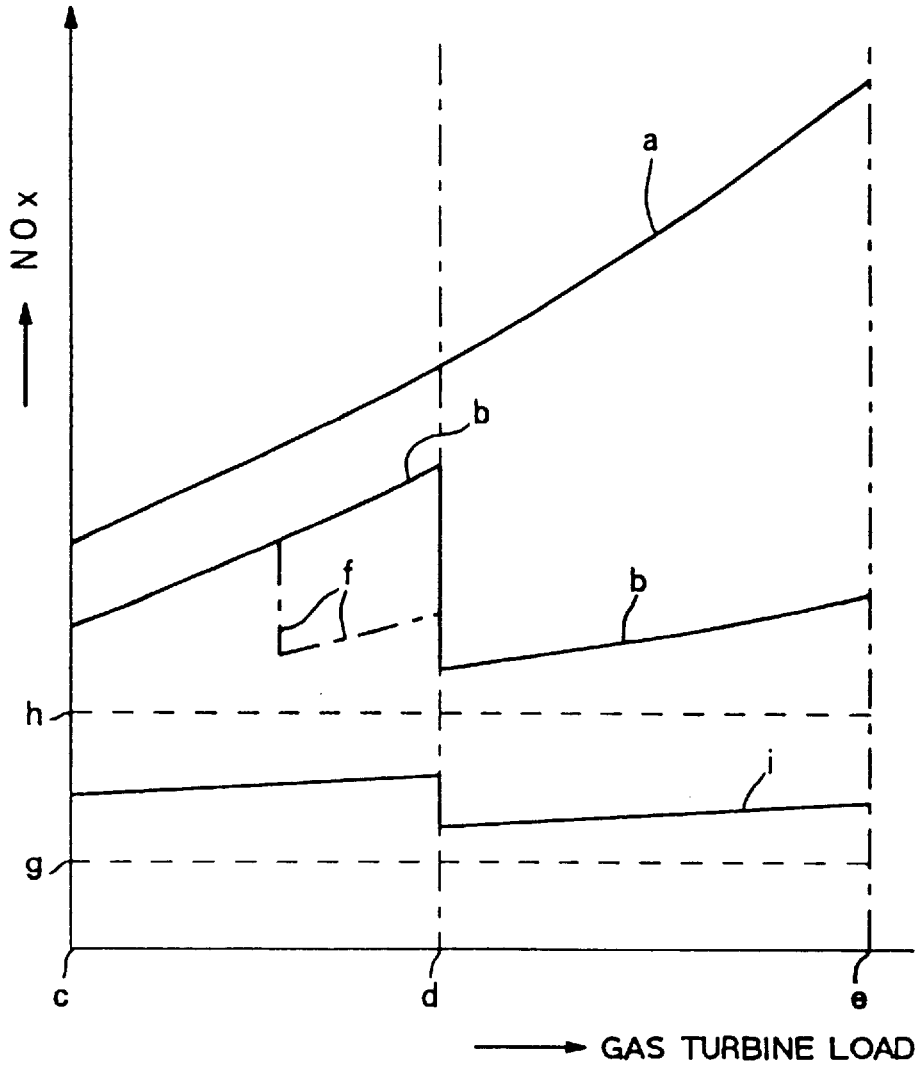
FIG. 12 illustrates NOx characteristics of the prior art.
Figure 13:
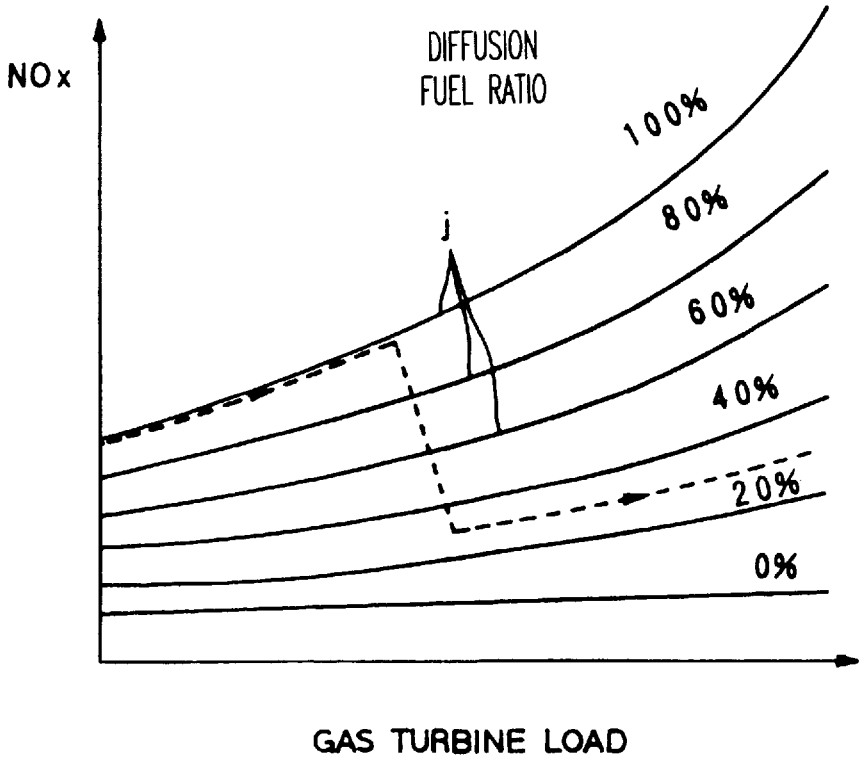
FIG. 13 illustrates NOx characteristics of the prior art.
Figure 14:
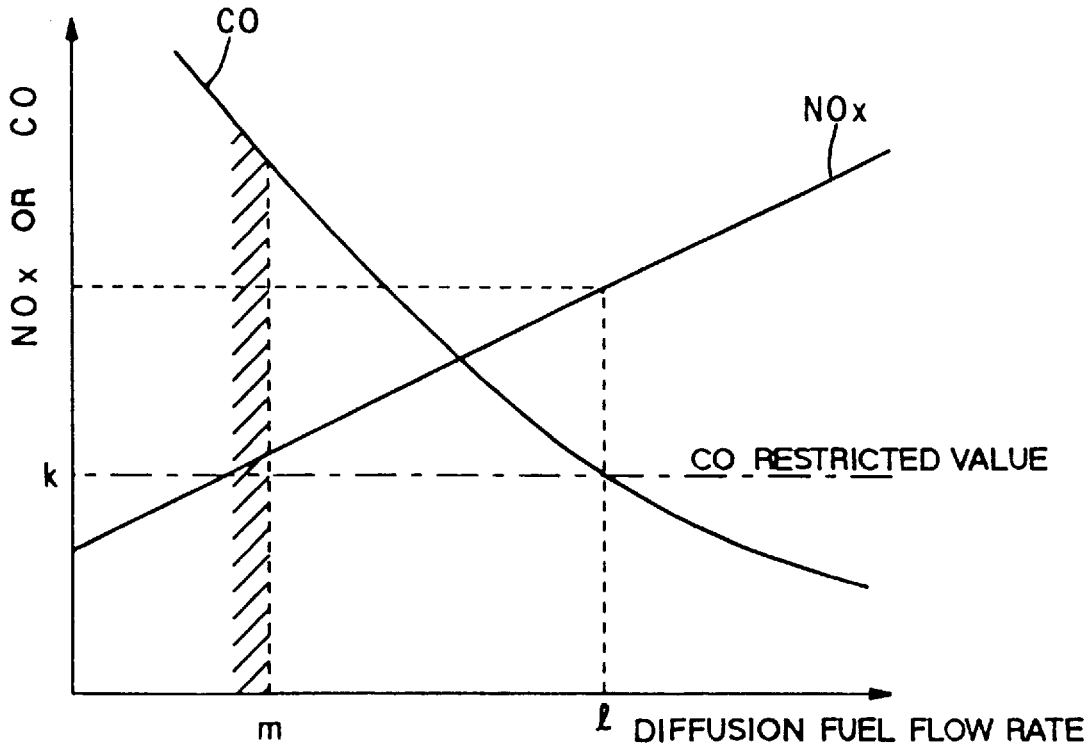
FIG. 14 illustrates the relation between NOx or Co and the proportion of a diffusion fuel flow rate.
Figure 15:
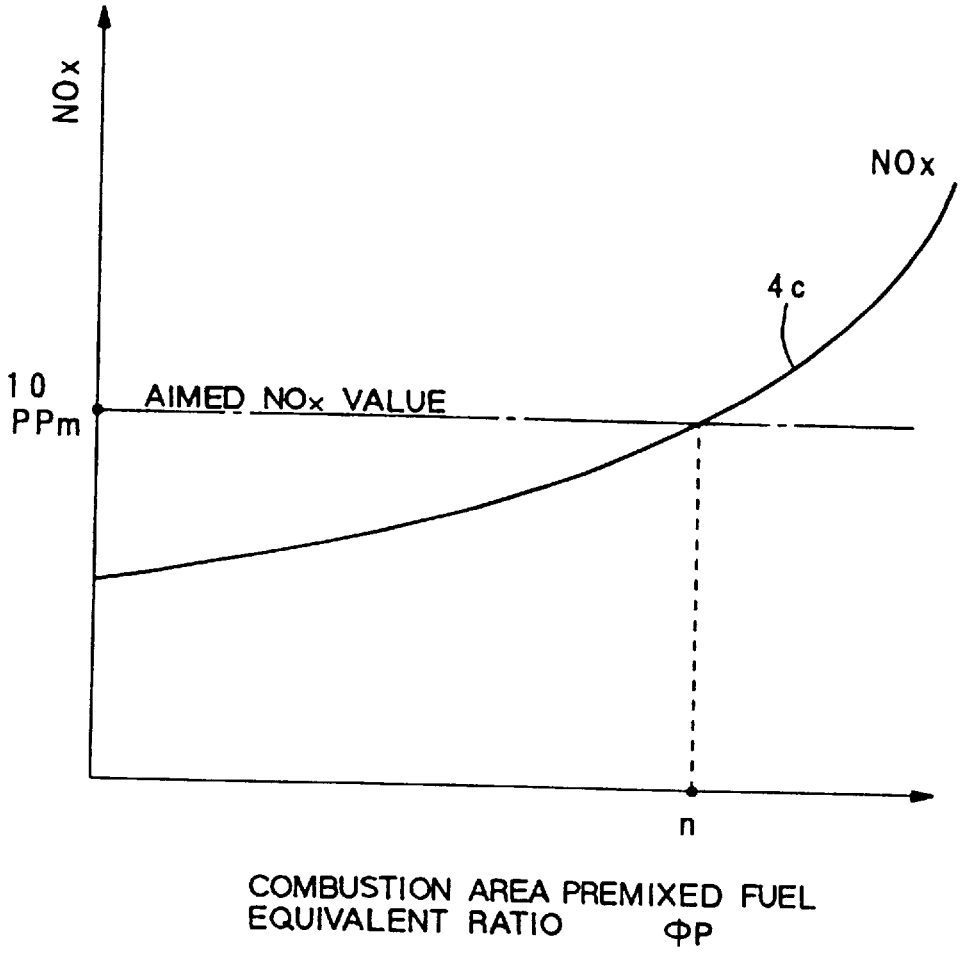
FIG. 15 illustrates the relation between NOx and the combustion range premixed equivalent ratio 15.
Figure 16B:
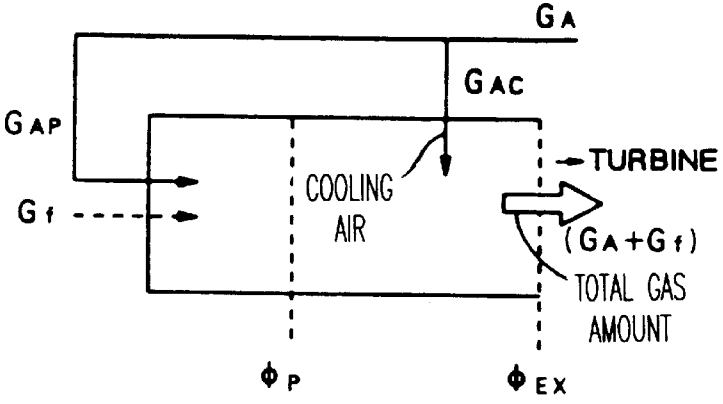
FIGS. 16A and 16B illustrate the relation between the wall surface cooling ratio and the fuel outlet equivalent ratio.
Figure 16A:
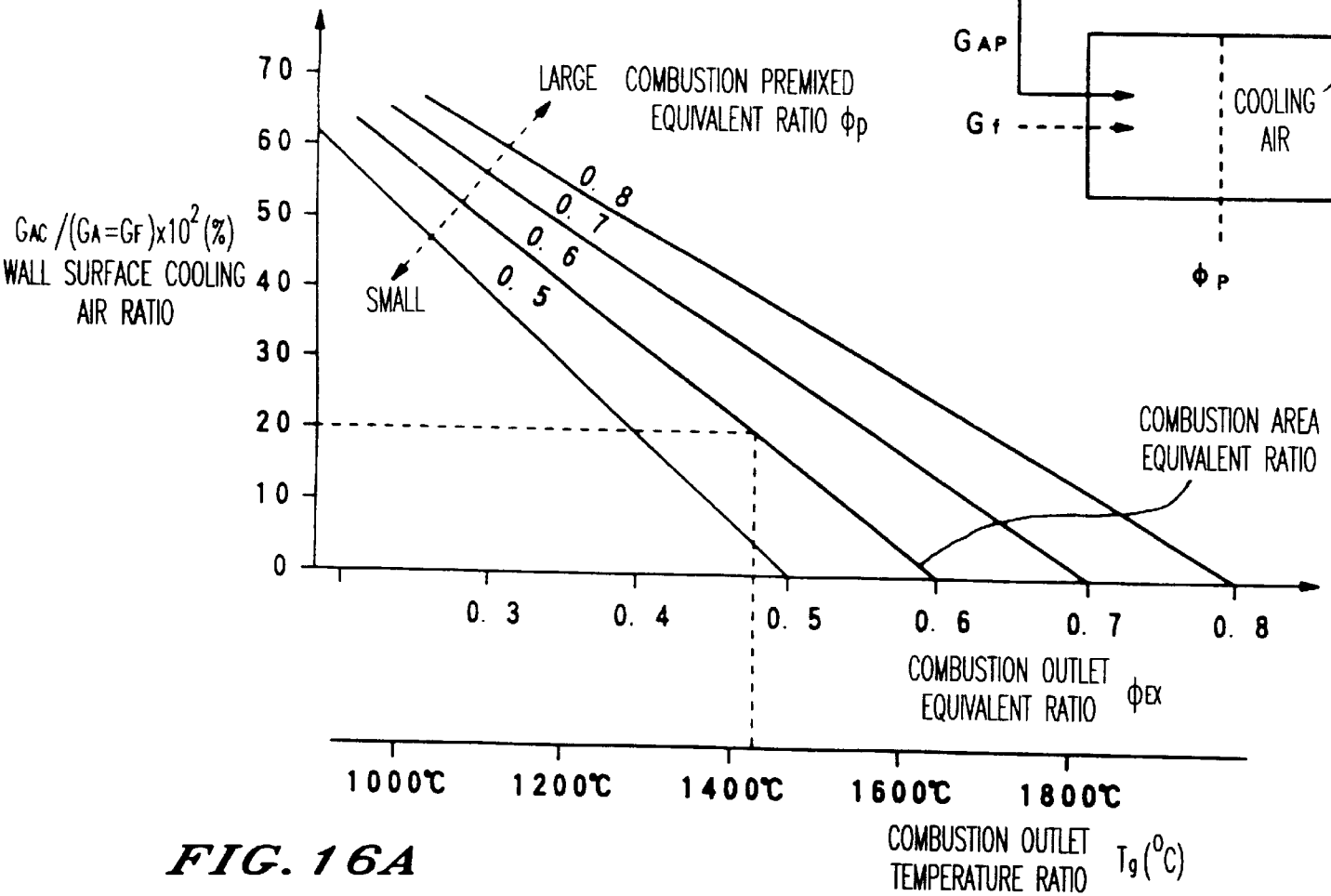

The computing element 42 controls the respective fuel flow rates such that the premixed fuels N1, N2, N3, N4 and N5 have a combustion temperature, less than 1600° C., which ensures generation of no NOx. Consequently, NOx characteristics (i) (see FIG. 12) can be made low over the entire gas turbine load region, unlike NOx characteristics (b) (see FIG. 12) of a conventional low NOx combustor, and the NOx objective value (h) (see FIG. 12) can thus be achieved.

Flames are stabilized by the adoption of so-called "series combustion" in which the premixed fuels of the first, second, third, fourth and fifth stages are ignited and burned in series by the high-temperature gas located upstream thereof to expand a flame.

Cooling of the combustor inner tube will be discussed.

A large part of the air supplied from the air compressor 50 to the combustor 1 passes through the impinging cooling holes 14 and 16 respectively formed in the tail outer tube 13 and the flow sleeve 15, and then collides against the tail inner tube 12 and the large-diameter inner tube 7 as the impinging jet A2 to cool the wall surfaces thereof by the convection flow.

The impinging jet A2 does not enter the combustor at the tail inner tube 13 but flows into the combustor as the combustion airs A3, A4, A5 and A6 of the premixing units 4*a*, 4*b*, 4*c* and 4*d* and as the combustion air A7 of the pilot burner 3.

At the small-diameter inner tubes 1*a* and 1*b* corresponding to the first combustion chamber 2*a*, less than 20% of the combustion air A1 flows into the combustor as a film cooling air to cool the inner surface thereof. That is, only cooling of the outer surface is conducted at the tail inner tube 12, so that the air to be used as a film cooling air can be used as combustion airs A3, A4, A5, A6 and A7, thus increasing the amount of combustion air. Consequently, a desired premixed fuel air ratio assuring a combustion temperature, less than 1600° C., which ensures generation of no NOx can be set, and a reduction in the NOx can thus be achieved.

The computing element 42 which performs the above-described combustion method will be discussed.

Figure 10:
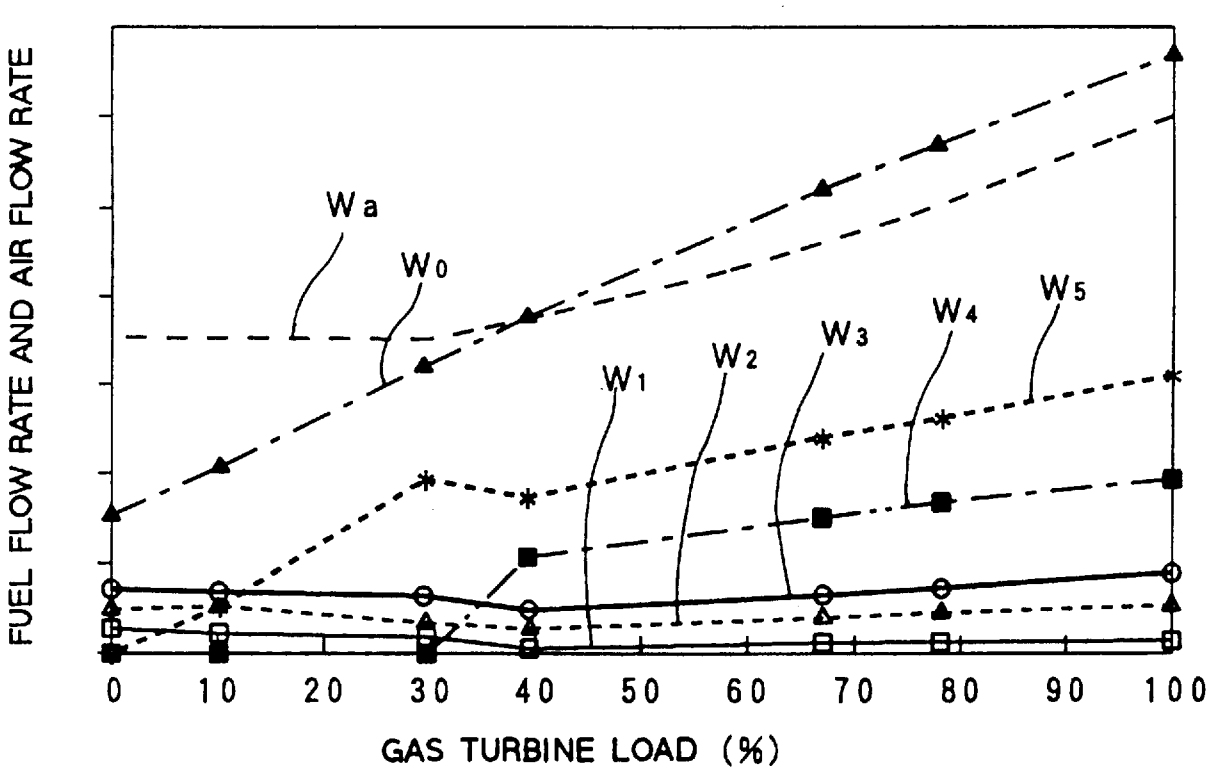
FIG. 10 is a graphic representation showing control characteristics of a computing element of the embodiment shown in FIG. 1.

As shown in FIG. 10, premixed fuel flow rates W1 through W5 of the five stages are stored beforehand as functions relative to a gas turbine load in the computing element 42 for the five stages of fuel lines. A total of the premixed fuel flow rates W1 to W5 is equal to a total fuel flow rate W0. The premixed fuel flow rates W1 to W5 of the five stages are obtained by the signal S103 using the flow rate adjusting valves 37, 39*a*, 39*b*, 39*c* and 39*d* relative to the load signal S107.

Figure 11:
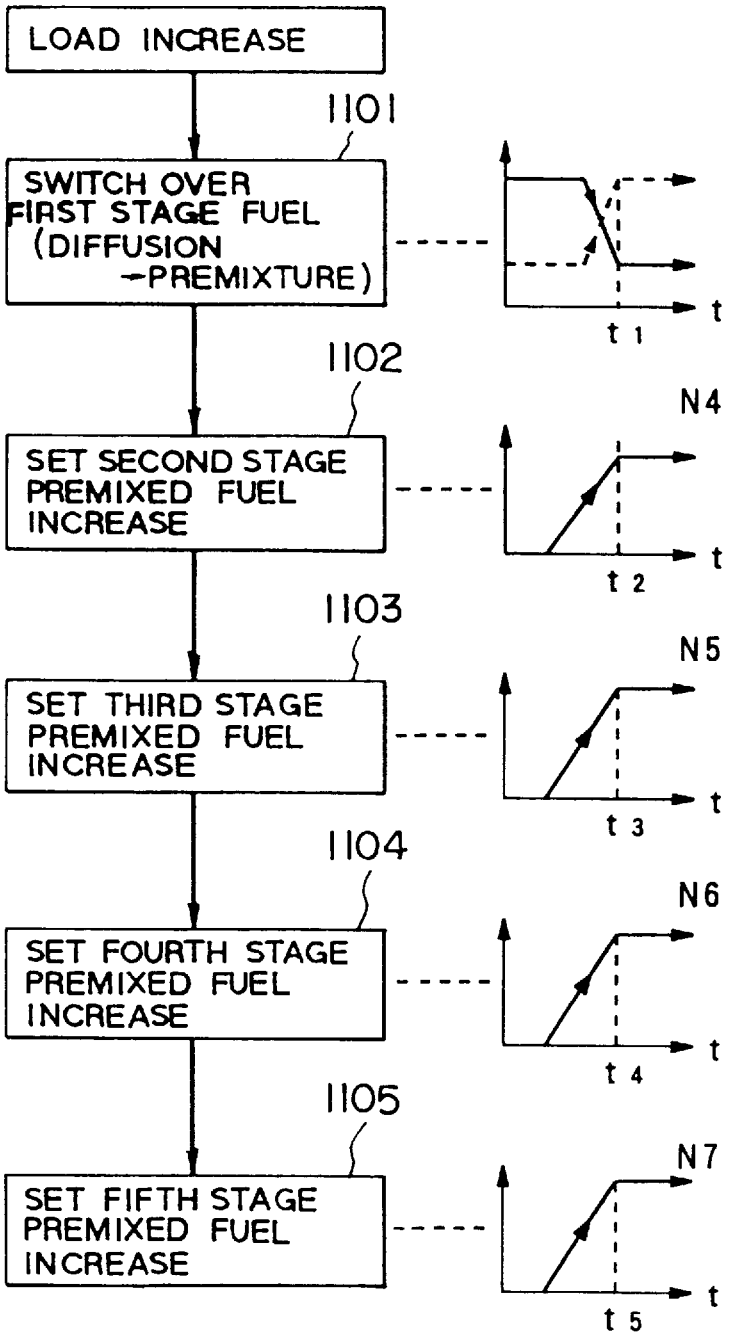
FIG. 11 is a flowchart illustrating the function of the embodiment shown in FIG. 1.

Referring to FIG. 11, where a load increases, the fuel of the first stage is replaced (step 1101), and then the premixed fuels of the respective stages are increased in sequence (steps 1102 to 1105).

Where a load decreases, the fuel flow rates of the respective stages are reduced in sequence starting with the fifth stage in the manner reversed to that shown in FIG. 11. Since an air flow rate Wa relative to the gas turbine load is substantially fixed, the combustor outlet temperature is determined by controlling the total fuel flow rate W0.

As shown in FIG. 4, the micro burners 5*a* for causing a small flame to issue are provided near the inverted flow regions of the inner tubes 1*a*, 1*b* and 7 to effectively stabilize the flames.

The above-described embodiment of the present invention is not restrictive and susceptible to various changes, modifications, variations and adaptations as will occur to those skilled in the art. FIGS. 6 through 9 illustrate such modifications of the present invention.

Figure 6:
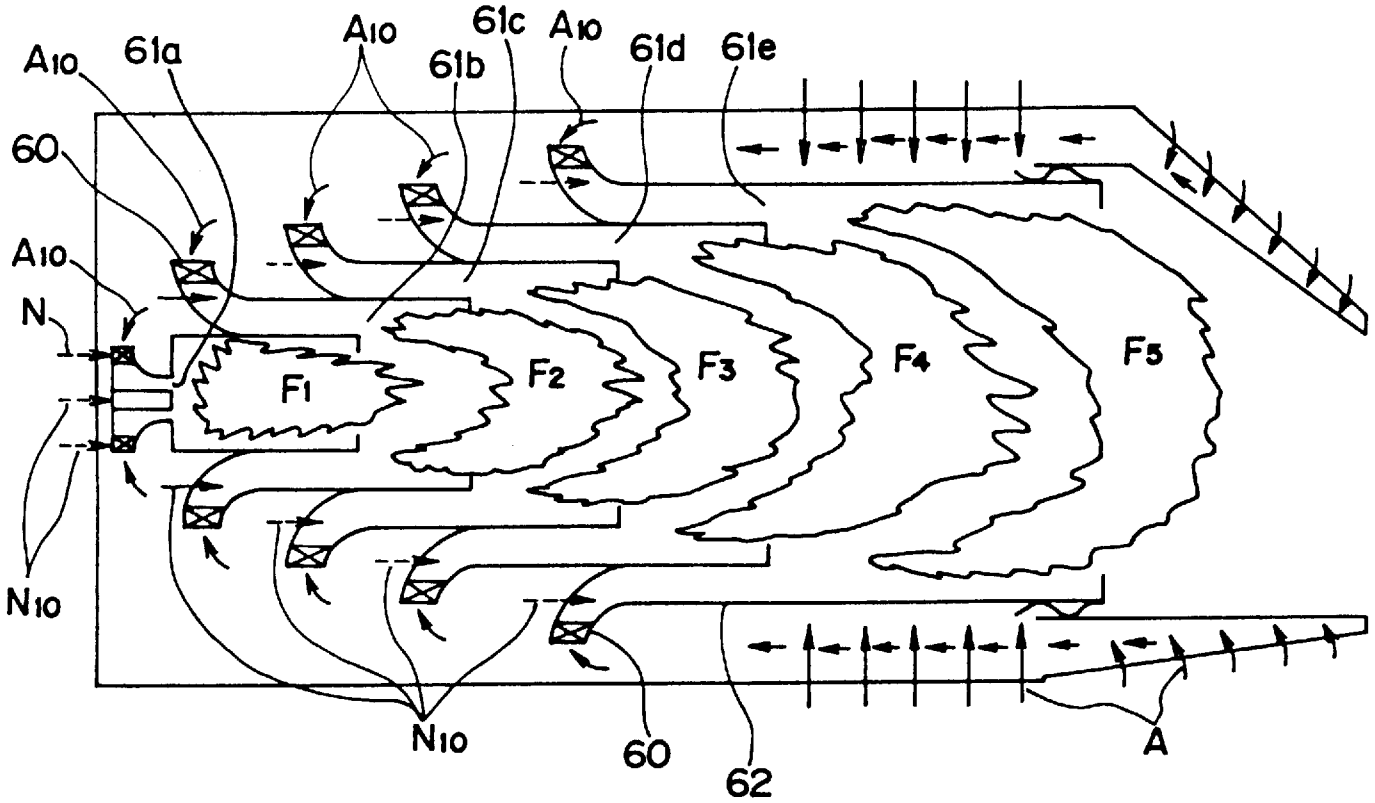
FIG. 6 illustrates a combustion portion of another embodiment of the present invention.

In the modification shown in FIG. 6, the fuel injection ports 18, 19*a*, 19*b*, 19*c* and 19*d* shown in FIG. 1 are modified such that they have an annular arrangement surrounded by double cylinders. That is, a combustion air A10 is swirled by a swirler 60 so that it has an annular momentum, and then flows into the cylinder from a fuel injection port 61*a*, 61*b*, 61*c*, 61*d* or 61*e* of the first, second, third, fourth or fifth stage. A fuel N10 is supplied to the respective injection ports through separate fuel supply systems, as in the case shown in FIG. 1. The premixed flames F1 through F5 are formed continuously in the axial direction of an inner tube 62 correspondingly with the fuel injection ports 61*a* through 61*e* of the first, second, third, fourth and fifth stages to achieve series combustion.

Figure 7:
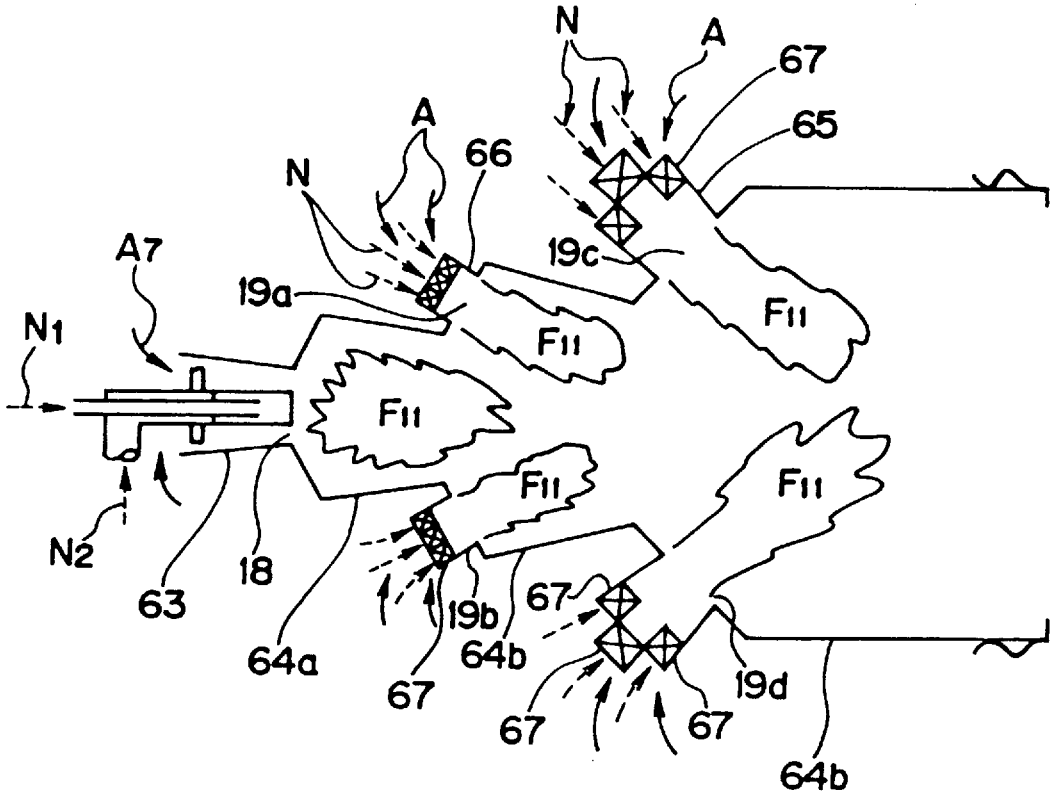
FIG. 7 illustrates a combustion portion of still another embodiment of the present invention.

In the modification shown in FIG. 7, although a pilot burner 63 is substantially the same as that of the embodiment shown in FIG. 1, 5 to 8, multi-burner type cylindrical premixing units 66 fixed to a second combustion chamber 64*b* (located downstream of a first combustion chamber 64*a*) are arrayed in the peripheral direction of the combustion chamber. Such an array is provided at two positions in the axial direction of the combustor. Swirlers 67 are provided in each of premixing units 66 to provide uniform premixing even in a short flow passage.

In this modification, flames are formed in series starting from the upstream side in the same manner as those of the above-described embodiment to form premixed flames F11, and generation of NOx can thus be effectively restricted.

Figure 8:
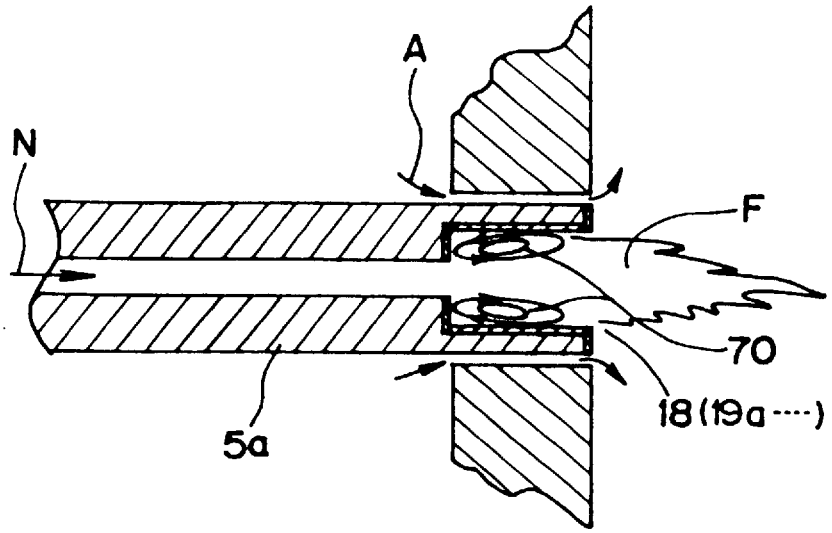
FIG. 8 illustrates a modification of a micro burner employed in the embodiment shown in FIG. 1.
Figure 9:
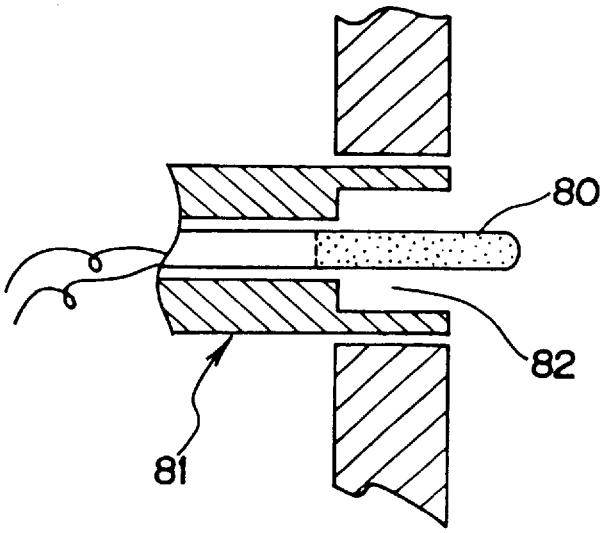
FIG. 9 illustrates an igniter which may be replaced with the micro burner employed in the embodiment shown in FIG. 1.

FIGS. 8 and 9 illustrate modifications of the micro burner shown in FIG. 1.

The modification shown in FIG. 8 contemplates a micro burner 5*a* having a configuration which assures premixed combustion by a self-holding flame. That is, the distal end portion of the premixed fuel injection port 18 (19*a*, - - - ) is widened so that eddy currents can be generated in the distal end portion to form self-holding flames 70. This configuration achieves further stabilization of flames. A heat-resistant coating layer 71 is formed at the distal end portion of the injection port.

In the modification shown in FIG. 9, an igniter is structured by a heating rod 81 having a high-temperature portion 80 whose temperature is increased to a value ensuring ignition by means of electrical energy. In this modification, the premixed fuel injection port 18 is formed wide, as in the case of the modification shown in FIG. 8, to form a staying region 82 of a fuel A.

The gas turbine combustor according to the present invention has been described above in its various embodiments and modifications. It is, however, to be emphasized that the present invention can be applied to various types of gas turbines which employ a gaseous or liquid fuel.

As will be understood from the foregoing description, in the gas turbine combustion system according to the present invention, simultaneous achievement of the super lean combustion condition, stable flame combustion and combustor wall surface cooling, which would conventionally be difficult, is made possible. As a result, NOx can be reduced to a desired aimed value or less (<10 ppm) over the entire operation range. A great reduction in NOx enables scale-down or elimination of a denitration device, reduces the operation cost including a reduction in an amount of ammonia consumed, and contributes to global environment purification.

What is claimed is:

1. A gas turbine combustion system comprising:

a cylindrical combustor having one end closed by a header;

a plurality of combustion sections in an arrangement spaced apart in an axial direction of the combustor;

a plurality of fuel supply lines independently connected to said combustion sections, respectively;

a plurality of igniter means respectively provided for said combustion sections and initiating the combustion in the respective combustion sections;

a plurality of premixed fuel supply sections respectively provided for said fuel supply lines and supplying a premixed fuel and having a premixed fuel nozzle;

a diffusion combustion fuel supply section supplying a diffusion combustion fuel to one of the combustion sections and having a diffusion combustion fuel nozzle; and a control unit switching over said fuel supply sections and selectively supplying either one of the premixed fuel and the diffusion combustion fuel;

said combustion sections including a first combustion stage, a second combustion stage and at least three succeeding combustion stages, totally at least five combustion stages, and said fuel supply lines including a fuel supply line for the first combustion stage which is divided into two fuel supply sections, one of which is connected to the diffusion combustion fuel nozzle of the diffusion fuel supply section and another one of which is connected to the premixed fuel nozzle of the premixed fuel supply section so that the control unit switches over a combustion condition from diffusion combustion to premixed combustion during operation of the gas turbine combustion system, and in at least one of said combustion stages, the premixed fuel is burned by the igniter means.

2. A gas turbine combustion system according to claim 1, wherein said igniter means comprises a micro burner.

3. A gas turbine combustion system according to claim 1, wherein said igniter means comprises a heating rod.

4. A gas turbine combustion system according to claim 1, wherein said combustion sections are formed as first and second combustion chambers defined by first and second members, respectively, said first member having an inner diameter smaller than that of the second member, said first combustion chamber having the first to third combustion stages and said second combustion chamber having the fourth to fifth combustion stages.

5. A gas turbine combustion system according to claim 4, wherein the first cylindrical member comprises an upstream side, first cylindrical portion, a downstream side, second cylindrical portion and an assembly including a pilot burner, a premixing device and an ignition device mounted to an upstream side end of a first cylindrical portion, and wherein another assembly including another premixing device and another ignition device is mounted to the second cylindrical portion.

6. A gas turbine combustion system according to claim 5, wherein said premixing devices are formed as premixing ducts arranged along circumferential directions of the first and second cylindrical portions and are provided with fuel nozzles communicating with upstream side air intake ports.

7. A gas turbine combustion system according to claim 5, wherein said pilot burner comprises a diffusion fuel nozzle, a premixture fuel nozzle and a swirler which are disposed along a central axis of the first cylindrical member.

8. A gas turbine system according to claim 5, wherein an assembly including a premixing device and an ignition device is mounted to the second combustion chamber, and said premixing device is formed as a premixing duct arranged along a circumferential direction of the second combustion chamber.

9. A gas turbine combustion system according to claim 1, wherein a flow sleeve covering an outer peripheral side of an inner cylindrical member and a tail cylindrical member comprising said combustor are provided, said flow sleeve having a plurality of holes through which a combustion air jet is caused to collide against an outer surface of said inner cylindrical member and an outer surface of said tail cylindrical member to cool metal comprising the inner cylindrical member and the tail cylindrical member, and wherein a total area of cooling air holes for film cooling, in which air is constantly flowing into the combustor to cool wall surface metal of the inner cylindrical member and the tail cylindrical member, is set to be 20% or less of a total area for combustion air.

10. A gas turbine combustion system comprising:

a cylindrical combustor having one end closed by a header;

a plurality of combustion sections in an arrangement spaced apart in an axial direction of the combustor;

a plurality of fuel supply lines independently connected to said combustion sections, respectively;

a plurality of igniters respectively provided for said combustion sections and initiating the combustion in the respective combustion sections;

a plurality of premixed fuel supply sections respectively provided for said fuel supply lines and supplying a premixed fuel and having a premixed fuel nozzle;

a diffusion combustion fuel supply section supplying a diffusion combustion fuel to one of the combustion sections and having a diffusion combustion fuel nozzle; and a control unit switching over said fuel supply sections and selectively supplying either one of the premixed fuel and the diffusion combustion fuel;

said combustion sections including a first combustion stage, a second combustion stage and at least three succeeding combustion stages, totally at least five combustion stages, and said fuel supply lines including a fuel supply line for the first combustion stage which is divided into two fuel supply sections, one of which is connected to the diffusion combustion fuel nozzle of the diffusion fuel supply section and another one of which is connected to the premixed fuel nozzle of the premixed fuel supply section so that the control unit switches over a combustion condition from diffusion combustion to premixed combustion during operation of the gas turbine combustion system, and in at least one of said combustion stages, the premixed fuel is burned by the igniters.

11. A gas turbine combustion system according to claim 10, wherein said igniters each comprise a micro burner.

12. A gas turbine combustion system according to claim 10, wherein each of said igniters comprise a heating rod.

13. A gas turbine combustion system according to claim 10, wherein said combustion sections are formed as first and second combustion chambers defined by first and second members, respectively, said first member having an inner diameter smaller than that of the second member, said first combustion chamber having the first to third combustion stages and said second combustion chamber having the fourth to fifth combustion stages.

14. A gas turbine combustion system according to claim 13, wherein the first cylindrical member comprises an upstream side, first cylindrical portion and a downstream side, second cylindrical portion and an assembly including a pilot burner, a premixing device and an ignition device is mounted to an upstream side end of the first cylindrical portion, and wherein another assembly including another premixing device and another ignition device is mounted to the second cylindrical portion.

15. A gas turbine combustion system according to claim 14, wherein said premixing devices are formed as premixing ducts arranged along circumferential directions of the first and second cylindrical portions and are provided with fuel nozzles communicating with upstream side air intake ports.

16. A gas turbine combustion system according to claim 14, wherein said pilot burner comprises a diffusion fuel nozzle, a premixture fuel nozzle and a swirler which are disposed along a central axis of the first cylindrical member.

17. A gas turbine combustion system according to claim 14, wherein an assembly including a premixing device and an ignition device is mounted to the second combustion chamber, and said premixing device is formed as a premixing duct arranged along the circumferential direction of a second combustion chamber.

18. A gas turbine combustion system according to claim 10, wherein a flow sleeve covering an outer peripheral side of an inner cylindrical member and a tail cylindrical member comprising said combustor are provided, said flow sleeve having a plurality of holes through which a combustion air jet is caused to collide against an outer surface of said inner cylindrical member and an outer surface of said tail cylindrical member to cool metal comprising the inner cylindrical member and the tail cylindrical member, and wherein a total area of cooling air holes for film cooling, in which air is caused to flow into the combustor to cool wall metal surface of the inner cylindrical member and the tail cylindrical member, is set to be 20% or less of a total area for combustion air.

* * * * *